United States Patent [19]

Ogawa

[11] Patent Number: 4,489,292

[45] Date of Patent: Dec. 18, 1984

[54] STUB TYPE BANDPASS FILTER

[75] Inventor: Hiroshi Ogawa, Tokyo, Japan

[73] Assignee: Nippon Electric Co., Ltd., Tokyo, Japan

[21] Appl. No.: 456,620

[22] Filed: Jan. 10, 1983

[30] Foreign Application Priority Data

Jan. 22, 1982 [JP] Japan ..... 57-9389

[51] Int. Cl.[3] ..... H01P 1/203; H01P 1/201

[52] U.S. Cl. ..... 333/202; 333/204; 333/246

[58] Field of Search ..... 333/202, 203, 204, 205, 333/206, 207, 219–223, 246

[56] References Cited

U.S. PATENT DOCUMENTS 2,964,718 12/1960 Packard ..... 333/204

3,345,589 10/1967 Di Piazza ..... 333/204

*Primary Examiner*—Marvin L. Nussbaum

*Attorney, Agent, or Firm*—Laff, Whitesel, Conte & Saret

[57] ABSTRACT

A bandpass filter has a line extending from an input terminal to an output terminal. Three stubs are connected to the line at three different locations on the line at a spacing which is $\frac{1}{8}$ of the wavelength, at the center frequency of the passband. Each of the three stubs is short-circuited at a first end and open at a second end and has a total length which is $\frac{1}{4}$ the wavelength of said center frequency. The outermost of the three stubs is connected to the transmission line, at a position which is 1/6 the wavelength, from the first end. The intermediate of the three stubs is connected to the line at a position which is either $\frac{1}{8}$ or $\frac{1}{4}$ the wavelength of the center frequency.

11 Claims, 8 Drawing Figures

STUB TYPE BANDPASS FILTER

BACKGROUND OF THE INVENTION

The present invention relates to a microwave bandpass filter adapted to use as a frequency converter and the like and, more particularly, to an improvement in a stub type bandpass filter which exhibits substantial attenuation to the waves which are double or treble its passband.

Stub type bandpass filters have been known in which a branch line or stub is associated with a transmission line such as a strip line, a microstrip line, wave guide and coaxial cable, to furnish is with filtering characteristics. One type of such bandpass filters has two stubs associated with a $\frac{1}{4}$ wavelength transmission line through which a signal is passed. This type of filters is generally classified into three kinds, i.e., a first filter in which the ends of both stubs are open, a second filter in which the ends of both stubs are short-circuited, and a third filter in which the end of one stub is open and the end of the other is short-circuited. In the second or third kind of filter, the stubs resonate responsive to the waves which are the integral multiples of the fundamental passband. It follows that the filter passes the waves which are the integral multiples of the passband as well. The third kind of filter passes the waves which are the odd multiples of the passband.

Thus, the prior art filter having two stubs connected with a $\frac{1}{4}$ wavelength transmission line passes the integral multiple waves of the passband. When such a filter is applied to a frequency converter or a mixer, it is impossible to confine higher-order harmonic signals in a mixer diode and, therefore, to reduce the conversion loss.

SUMMARY OF THE INVENTION

It is an object of the present invention to provide a stub type bandpass filter which has an improved stop or rejection characteristic relative to the double or treble waves of its passband.

In accordance with the present invention, a stub type bandpass filter comprises a transmission line extending between an input terminal and an output terminal. Three stubs are connected to the transmission line at three different locations. The distance between the adjacent stubs is equal to $\frac{1}{8}$ the wavelength of the center frequency of the passband. Each stub is short-circuited at one end and open at the other end, and has a $\frac{1}{4}$ wavelength. The outermost of these three stubs is connected to the transmission line each at a point which is 1/6 the wavelength, measured from the short-circuited end. The intermediate stub is connected to the line at a point which is $\frac{1}{8}$ or $\frac{1}{4}$ the wavelength from its short-circuited end.

BRIEF DESCRIPTION OF THE INVENTION

The present invention will be described with reference to the accompanying drawings.

Figure 1:
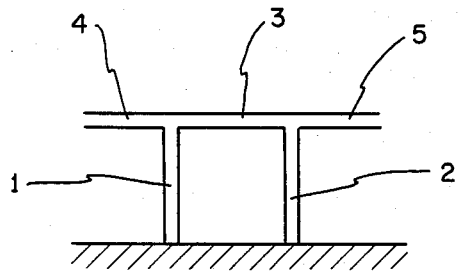
FIG. 1 PRIOR ART
FIG. 1 is a diagram showing a prior art $\frac{1}{4}$ wavelength stub type bandpass filter.
Figure 2:
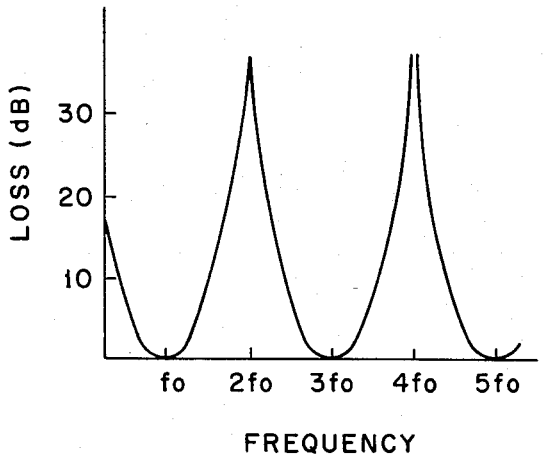
FIG. 2 is a graph showing the conversion loss relative to frequency characteristic of the filter shown in FIG. 1.

Referring to FIG. 1, the prior art band pass filter used a pair of $\frac{1}{4}$ wavelength stubs 1,2 connected to a $\frac{1}{4}$ wavelength transmission. With this structure, the filter passes odd multiple waves 3fo and 5fo (FIG. 2) cutting off even multiple waves 2fo and 4fo, as shown in FIG. 2. The filter may be fabricated by using microstrip and strip line techniques.

Figure 3:
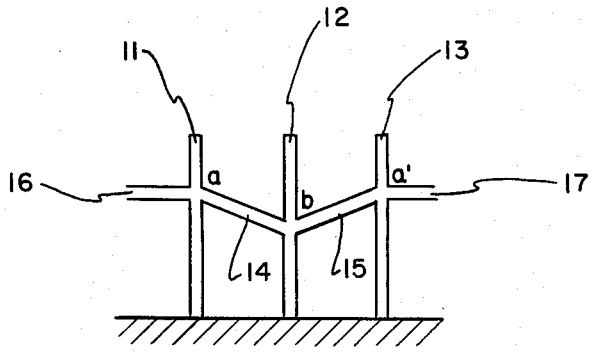
FIG. 3 is a diagram showing a stub type bandpass filter embodying the present invention.

Referring to FIG. 3, a stub type bandpass filter embodying the present invention comprises three stubs 11, 12 and 13. Each of the stubs 11, 12 and 13 comprises a $\frac{1}{4}$ wavelength line which is short-circuited to ground at one end and open at the other end. The stubs 11, 12 and 13 are interconnected by $\frac{1}{8}$ wavelength connection lines 14 and 15, comprising strip lines. The interconnecting lines 14 and 15 are connected to input and output terminals 16 and 17, respectively. The stub 11 is connected to the line 14 at a junction a while the stub 13 is connected to the line 15 at a junction a'. The stub 12 is connected to the lines 14 and 15 at a junction b. The junction a or a' is located at a position which is substantially 1/6 the wavelength of the center frequency of the bandpass, as measured from the ground point of the associated stub 11 or 13. The junction b is located at a position which is substantially $\frac{1}{8}$ the wavelength, as measured from the ground point of the stub 12.

In the structure shown in FIG. 3, the junctions a and a' of the stubs 11 and 13 have zero impedance against the treble wave (third harmonic) because they are respectively located at the 1/6 wavelength positions, as measured from their ground points. Therefore, a bandpass filter in the form of the FIG. 3 circuit cuts off the treble wave or third harmonic.

The stub 12, on the other hand, has zero impedance at its junction b against the double wave (second harmonic) due to the position of its junction b, which is $\frac{1}{8}$ the wavelength from the open end, so that it cuts off the double wave or second harmonic.

Figure 4:
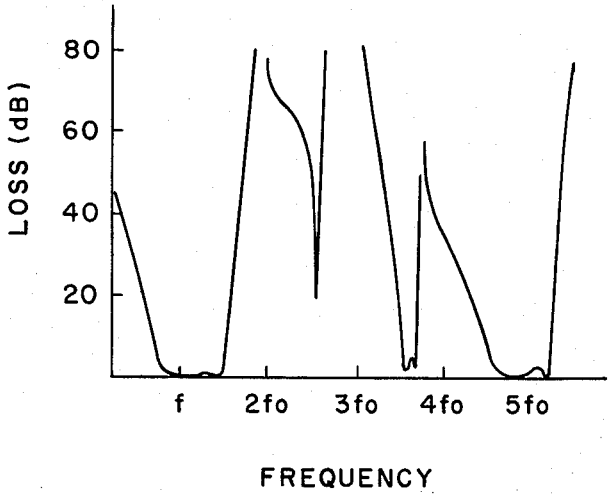
FIG. 4 is a graph representing the conversion loss relative to frequency characteristic of the filter shown in FIG. 3.

It will be seen from the conversion loss to frequency characteristic shown in FIG. 4 that the filter arrangement of FIG. 3 greatly attenuates the double wave (second harmonic) 2fo and treble wave (third harmonic) 3fo.

Figure 5:
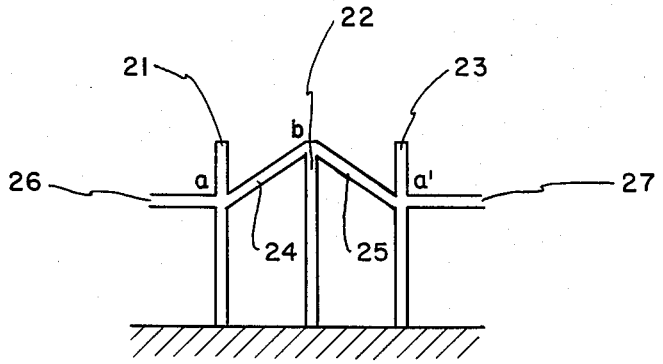
FIG. 5 is a diagram showing another embodiment of the present invention.

Referring to FIG. 5, the bandpass filter comprises three stubs 21, 22 and 23 each being constituted by a $\frac{1}{4}$ wavelength line which is short-circuited to ground at one end and open at the other end. The stubs 21, 22 and 23 are interconnected by $\frac{1}{8}$ wavelength connection lines 24 and 25 which are connected to input and output terminals 26 and 27, respectively. The stub 21 is connected to the line 24 at a junction a; the stub 23, to the line 25 at a junction a'; and the stub 22, to the lines 24 and 25 at a junction b. The junctions a and a' are respectively located at 1/6 wavelength positions from the short-circuited ends of their associated stubs 21 and 23. The junction b is positioned at the open end of the stub 22.

Figure 6:
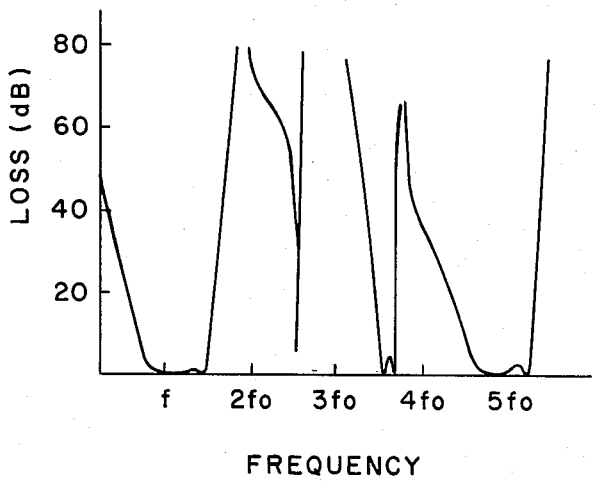
FIG. 6 is a graph showing the conversion loss relative to frequency characteristic of the filter shown in FIG. 5.

In the filter structure shown in FIG. 5, the stubs 21 and 23 cut off the treble wave (third harmonic). The junction b, which is located at the $\frac{1}{4}$ wavelength position as measured from the ground end of the stub 22, shows zero impedance against the double wave (second harmonic). As a result, the bandpass filter has stop or rejection bands against both the double and treble waves (second and third harmonics). FIG. 6 demonstrates the conversion loss to frequency characteristic which is achievable with the circuitry shown in FIG. 5.

Figure 7:
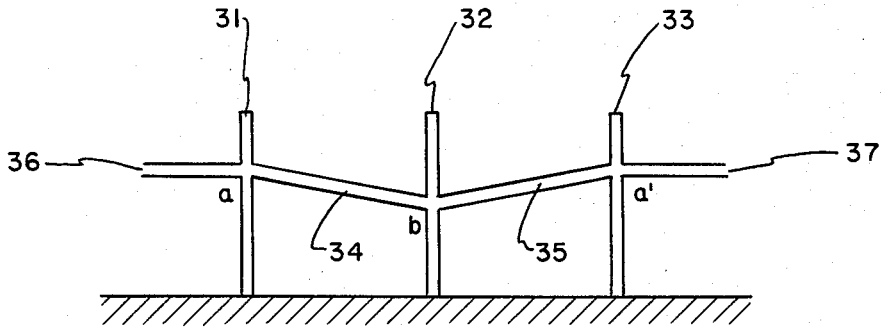
FIG. 7 is a diagram of still another embodiment of the present invention.

Referring to FIG. 7, the bandpass filter is similar to the filter of FIG. 3 except for the lengths of the connection lines. As shown, the circuitry includes $\frac{1}{4}$ wavelength stubs 31, 32 and 33 each of which is open at one end and short-circuited at the other end. The stubs 31, 32 and 33 are interconnected by $\frac{1}{4}$ wavelength connection lines 34 and 35 which are connected to input and output terminals 36 and 37, respectively. Junctions a and a' are located at 1/6 wavelength positions from the short-circuited ends of their associated stubs 31 and 33. A junction b is located at the $\frac{1}{8}$ wavelength position from the short-circuited end of the stub 32.

Figure 8:
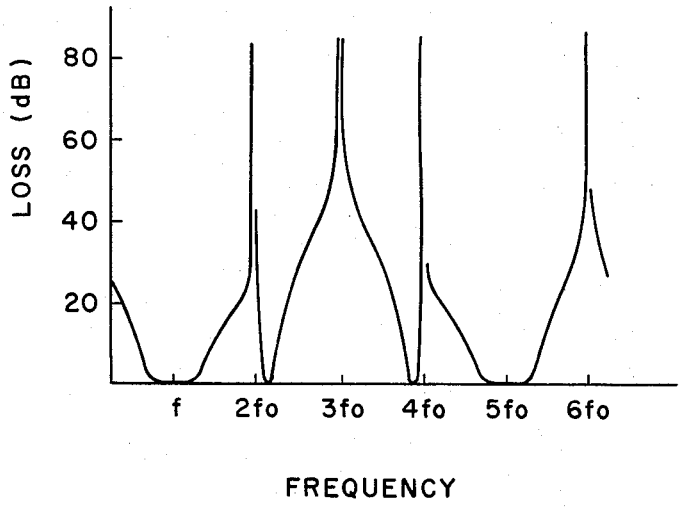
FIG. 8 is a graph showing the conversion loss relative to frequency characteristic of the filter shown in FIG. 7.

The conversion loss to frequency characteristic of the filter shown in FIG. 7 is illustrated in FIG. 8. It will be seen that, although the filter cuts off the double and treble waves (second and third harmonics), it fails to sufficiently reject the higher harmonic band of the base passband. Thus, the filter of FIG. 7 is inferior to that of FIG. 3 due to its bulky structure and poor passing characteristics.

In summary, it will be seen that the present invention provides a bandpass filter which shows great attenuation against the double and treble wave bands (second and third harmonics) of its passband. The filtering characteristic is stable despite its simple structure. The filter will prove quite effective when applied to a frequency converter.

Various modifications will become possible for those skilled in the art after receiving the teachings of the present disclosure, the modifications being made without departing from the scope thereof. For example, the strip line employed as the connection line in the embodiments shown and described may be replaced by a waveguide, coaxial cable or the like. Meanwhile, because the characteristic impedance of the lines appear at the input and output terminals of the bandpass filter of the present invention, a plurality of such filters may be cascaded together.

What is claimed is:

1. A bandpass filter comprising:

transmission line means extending from an input terminal to an output terminal; and three stubs sequentially connected to said transmission line means at three different locations along the length of said transmission line means, said stubs being connected to said transmission line means at spacings which separate said stubs from each other by a distance equal to $\frac{1}{8}$ the wavelength of the center frequency of the passband;

each of said three stubs being short-circuited at a first end and open at a second end and having a total length which is $\frac{1}{4}$ the wavelength of said center frequency;

the outermost two of said three stubs being connected to said transmission line means at positions which are 1/6 the wavelength of said center frequency from said first short circuited end;

the intermediate one of said three stubs being connected to said transmission line means at a position which is $\frac{1}{8}$ the wavelength of said center frequency from said first short circuited end.

2. A bandpass filter comprising:

transmission line means extending from an input terminal to an output terminal; and three stubs sequentially connected to said transmission line means at three different locations along the length of said transmission line means, said stubs being connected to said transmission line means at spacings which separate said stubs from each other by a distance equal to $\frac{1}{8}$ the wavelength of the center frequency of the passband;

each of said three stubs being short-circuited at a first end and open at a second end and having a total length which is $\frac{1}{4}$ the wavelength of said center frequency;

the outermost two of said three stubs being connected to said transmission line means each at positions which are 1/6 the wavelength of said center frequency from said first short circuited end;

the intermediate one of said three stubs being connected to said transmission line means at a position which is $\frac{1}{4}$ the wavelength of said center frequency from said first short circuited end.

3. A filter for passing a band of frequencies while suppressing higher harmonics of the center frequency of said pass band, said filter comprising a transmission line having three stubs sequential connected thereto at intervals which are a uniform fraction of said center frequency, each of said stubs being a quarter wave length long and having a grounded end and an open end, the stubs in the first and last positions of said sequence being connected to said line at first locations which are first fraction of the wave length of said center frequency, and the stub in the center position of said sequence being connected to said line at a second location which is another fraction of said center frequency, each of said locations being a distance measured along the length of said stub beginning at the grounded end.

4. The filter of claim 3 wherein said first fraction is one-sixth, and both said uniform fraction and said other fraction are one-eight.

5. The filter of claim 3 wherein said uniform fraction is one-eight, said first fraction is one-sixth, and said other fraction is one-quarter.

6. The filter of claim 3 wherein said uniform fraction is one-quarter, said first fraction is one-sixth, and said other fraction is one-eighth.

7. A filter for passing a band of frequencies while suppressing higher harmonics of the center frequency of said passband, said filter comprising a transmission line having three stubs sequential connected at uniform intervals along the length of said line, each of said stubs having a length which is one-quarter the wavelength of said center frequency and being grounded at one end and open at the other end, the stubs in the first and last positions of said sequence being connected to said line at first locations measured along the length of said stub, said first locations forming the grounded ends of said first and last stubs into short circuits for one of said higher harmonics, and the stub in the center position of said sequence being connected to said line at a second location measured along the length of said stub, said second location forming the grounded end of said center stub into a short circuit for another of said harmonics.

8. The filter of claim 7 wherein said higher harmonics are the second and third harmonics of said center frequency.

9. The filter of claim 8 wherein said uniform interval is one-half the wavelength of said second harmonic, said first and last position stubs are connected to said line at said first locations which are one half wavelength of said third harmonic, and said center stub is connected at said second location which is one-half the wavelength of said second harmonic.

10. The filter of claim 8 wherein said uniform interval is one-half the wavelength of said second harmonic, said first and last position stubs are connected to said line at said first locations which are one-half the wavelength of said third harmonic, and said center stub is connected at said second location which is one-half the wavelength of said second harmonic.

11. The filter of claim 8 wherein said uniform interval is the wavelength of said second harmonic, said first and last position stubs are connected to said line at said first locations which are one-half the wavelength of said third harmonic, and said center stub is connected at said second location which is one-half the wavelength of said second harmonic.

* * * * *